United States Patent [19]

Perry

[11] Patent Number: 4,506,893

[45] Date of Patent: Mar. 26, 1985

[54] METHOD OF PLAYING A GAME IN WHICH PLAYING PIECES ARE INVERTED

[76] Inventor: Mark E. Perry, 5030 N. 35th St., Arlington, Va. 22207

[21] Appl. No.: 479,262

[22] Filed: Mar. 28, 1983

[51] Int. Cl.[3] ..... A63F 3/02

[52] U.S. Cl. ..... 273/258; 273/260

[58] Field of Search ..... 273/260, 261, 262, 263, 273/242, 243, 248, 249, 258, 291

[56] References Cited

U.S. PATENT DOCUMENTS

| | | | |
|---|---|---|---|
| 1,492,073 | 4/1924 | Cornell et al. | 273/258 |
| 1,780,038 | 10/1930 | Parker | 273/261 X |
| 2,549,495 | 4/1951 | Lightfoot et al. | 273/248 |
| 3,455,556 | 7/1969 | Mossman | 273/258 |
| 3,633,913 | 1/1972 | Solimene | 273/248 |
| 3,918,715 | 11/1975 | Puglisi | 273/260 X |
| 4,019,746 | 4/1977 | Hare | 273/260 X |

FOREIGN PATENT DOCUMENTS

| | | | |
|---|---|---|---|
| 2377210 | 9/1978 | France | 273/260 |

*Primary Examiner*—Richard C. Pinkham
*Assistant Examiner*—Matthew L. Schneider
*Attorney, Agent, or Firm*—Ronald E. Smith

[57] ABSTRACT

A board game having a squarely configured playing board is subdivided into eight (8) rows and eight (8) columns of uniformly dimensioned squares. Each square is provided with a numeral so that the squares appear to be randomly numbered although the pattern of such numbering system corresponds to the Table of Numbers from the Book of Change (I Ching), an ancient Chinese manuscript. The playing pieces are coded so that each playing piece has a top half and a bottom half. In playing the game, jumping an opponent's piece results in inversion of the jumped piece and such inverted piece may regain its original, upright position by jumping an opponent's piece. However, an inverted piece must be removed from the board if it is jumped a second time. The game is won by either capturing, by jumping, all of one's opponent's pieces, or by successfully arranging three of one's own pieces in contiguous, linearly aligned relation to one another on an opponent's back row. In one move, a piece may move from a border row or column on one side of the playing board to a border row or column on the opposite side of the playing board. Thus, the two dimensional playing board in effect acquires an additional dimension.

7 Claims, 5 Drawing Figures

CH'IEN (HEAVEN)

| | A | B | C | D | E | F | G | H |
|---|---|---|---|---|---|---|---|---|
| a | 1 | 34 | 5 | 26 | 11 | 9 | 14 | 43 |
| b | 25 | 51 | 3 | 27 | 24 | 42 | 21 | 17 |
| c | 6 | 40 | 29 | 4 | 7 | 59 | 64 | 47 |
| d | 33 | 62 | 39 | 52 | 15 | 53 | 56 | 31 |
| e | 12 | 16 | 8 | 23 | 2 | 20 | 35 | 45 |
| f | 44 | 32 | 48 | 18 | 46 | 57 | 50 | 28 |
| g | 13 | 55 | 63 | 22 | 36 | 37 | 30 | 49 |
| h | 10 | 54 | 60 | 41 | 19 | 61 | 38 | 58 |

10 12 12

YIN YANG

TUI (LAKE)

FIG_1

CH'IEN (HEAVEN)

10

| | A | B | C | D | E | F | G | H |
|---|---|---|---|---|---|---|---|---|
| a | 1 | 34 | 5 | 26 | 11 | 9 | 14 | 43 |
| b | 25 | 51 | 3 | 27 | 24 | 42 | 21 | 17 |
| c | 6 | 40 | 29 | 4 | 7 | 59 | 64 | 47 |
| d | 33 | 62 | 39 | 52 | 15 | 53 | 56 | 31 |
| e | 12 | 16 | 8 | 23 | 2 | 20 | 35 | 45 |
| f | 44 | 32 | 48 | 18 | 46 | 57 | 50 | 28 |
| g | 13 | 55 | 63 | 22 | 36 | 37 | 30 | 49 |
| h | 10 | 54 | 60 | 41 | 19 | 61 | 38 | 58 |

YIN

YANG

12

12

TUI (LAKE)

FIG_2

12

10

| | | | | | | | | |
|---|---|---|---|---|---|---|---|---|
| | 1 | 34 | 5 | 26 | 11 | 9 | 14 | 43 |
| | 25 | X | X | 27 | 24 | 0 | 0 | 17 |
| | 6 | X | X | 4 | 7 | 0 | 0 | 47 |
| | 33 | X | X | 52 | 15 | 0 | 0 | 31 |
| | 12 | X | X | 23 | 2 | 0 | 0 | 45 |
| | 44 | X | X | 18 | 46 | 0 | 0 | 28 |
| | 13 | X | X | 22 | 36 | 0 | 0 | 49 |
| | 10 | 54 | 60 | 41 | 19 | 61 | 38 | 58 |

12

PLAYER-A

PLAYER-B

12

10

PLAYER-A

| | | | | | | | |
|---|---|---|---|---|---|---|---|
| 1 | X | X | 26 | 11 | 0 | 0 | 43 |
| 25 | X | X | 27 | 24 | 0 | 0 | 17 |
| 6 | X | X | 4 | 7 | 0 | 0 | 47 |
| 33 | X | X | 52 | 15 | 0 | 0 | 31 |
| 12 | 16 | 8 | 23 | 2 | 20 | 35 | 45 |
| 44 | 32 | 48 | 18 | 46 | 57 | 50 | 28 |
| 13 | 55 | □ | □ | □ | □ | 30 | 49 |
| 10 | 54 | □ | □ | □ | □ | 38 | 58 |

PLAYER-B

PLAYER-C

PLAYER-D

10

PLAYER-A

| | | | | | | | |
|---|---|---|---|---|---|---|---|
| 1 | 34 | 5 | 26 | 11 | 9 | 14 | 43 |
| 25 | X | X | 27 | ⊠ | ⊠ | ⊠ | 17 |
| 6 | X | X | 4 | ⊠ | ⊠ | ⊠ | 47 |
| 33 | X | X | 52 | 15 | 53 | 56 | 31 |
| 12 | 16 | 8 | 23 | 2 | □ | □ | 45 |
| 44 | 0 | 0 | 0 | 46 | □ | □ | 28 |
| 13 | 0 | 0 | 0 | 36 | □ | □ | 49 |
| 10 | 54 | 60 | 41 | 19 | 61 | 38 | 58 |

PLAYER-C

12

PLAYER-B

METHOD OF PLAYING A GAME IN WHICH PLAYING PIECES ARE INVERTED

BACKGROUND OF THE INVENTION

1. Field of the Invention

This invention relates, generally, to board games, and more specifically relates to a board game that introduces the players to an ancient Chinese book of divination.

2. Description of the Prior Art

Board games are ubiquitous. However, the known board games are generally played on two-dimensional surfaces and the play is confined to the physical boundaries of the board.

Moreover, in typical board games involving the capture of opponent pieces by jumping maneuvers, it is common to capture the piece by jumping it one time. Most importantly, the board games of the prior art simply come to an end when all of the opponent's pieces have been captured.

There is a need for a two-dimensional board game that provides to its players the concept of an additional dimension. Thus, there should be a board game whereby an apparent departure from the board results in a simultaneous and corresponding appearance of arrival on the same board. Such a board and board game would teach its players the philosophical concept known as the law of opposites (the yin-yang theory). More specifically, the yin-yang theory teaches that apparent opposites are in reality the same thing. Accordingly, a departure from the board is actually an arrival on the board, just as the departure of the summer season and the apparent arrival of the winter season are merely apparent changes in that the underlying cycle of seasons is unchanged. In other words, the only immutable law is the law of change itself, as made clear by the I-Ching text, and as would become clear to the players of the board game that would teach such concept.

However, such a board game does not appear in the prior art.

SUMMARY OF THE INVENTION

The longstanding but heretofore unfufilled need for a board game that would teach its players the art of divination is now provided in the form of a board game that is played on a square in configuration, two-dimensional board that has been subdivided into sixty-four (64) squares of uniform dimension, each square bearing a numeral thereon corresponding to the numerals disclosed in the ancient Book of Change and known as the Table of Numbers.

The novel playing board, although apparently a two-dimensional board having the dimensions of length and width, is transposed by the novel method disclosed herein into a board having another dimension. Specifically, pieces movable upon the board may depart therefrom, only to reappear on the other side thereof. Those familiar with video games such as Pac Man (Trademark) will notice the similarity and will understand how a disappearance from one edge of the board and a simultaneous reappearance on an opposite edge thereof is accomplished.

This ability of playing pieces to disappear and reappear is philosophically instructive to the game's players, and greatly increases the challenge of playing the game, since the conventional confines of a board game are thereby obviated.

Play upon the two-dimensional surface of the game board bears some resemblance to more conventional board games, however. Pieces are captured by being jumped, although in one variation of the game a piece must be jumped twice before it can be captured, and a once-jumped piece may regain its upright, uninverted position by successfully jumping another opposing piece. Symbolically, this gives each piece a second life, in that it is not necessarily removed from the playing board after being jumped only once. Moreover, that playing piece with one defeat can reverse the defeat through conscious effort, i.e., by jumping an opponent's piece. Understood in this manner, the opposing pieces are merely obstacles to be overcome. A once inverted piece has failed to overcome its obstacles but is not removed until it fails again to overcome its obstacles. This teaches the players the concept of karma and of course increases the skill required to play the game.

It is therefore seen to be an important object of this invention to provide a game that teaches difficult philosophical concepts to its players.

A related object of this invention is to provide a board game having a playing board that has the appearance of a planar in configuration two-dimensional board, but which in reality includes another dimension.

Still another object is to provide a game that gives defeated pieces repeated chances to overcome their earlier setbacks to regain their prior undefeated configuration.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which:

FIG. 1 is a top plan view of the playing board of this invention.

FIG. 2 is a top plan view of the playing board of FIG. 1, showing how twenty-four (24) playing pieces are divided into two groups of twelve (12) playing pieces each and showing how such pieces are positioned at the beginning of play.

DETAILED DESCRIPTION OF THE PREFERRED EMBODIMENT

Figures 3, 4, 5:
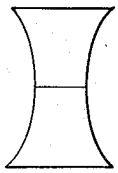
FIG. 3 is a top plan view of the playing board of FIG. 1, showing how the playing pieces are initially arranged thereupon when three player are playing the novel game.
FIG. 4 is a top plan view of the playing board of FIG. 1, showing how the playing pieces are arranged thereupon at the commencement of the game when four players are playing the game.
FIG. 5 is a side elevational view of a playing piece, showing how it may be color coded to have an upper half and a lower half.

Referring now to FIG. 1, it will there be seen that the playing board upon which the pieces move is indicated by the reference numeral 10 as a whole. In the preferred embodiment, the board 10 is subdivided into sixty-four (64) squares of equal dimensions, such squares being collectively referred to by the reference numeral 12. As will become clear as this description proceeds, however, similar games could be designed and played in accordance with the teachings of this invention wherein the playing board is subdivided into different arrangements. For example, the individual positions 12 need not be square, but could in fact be provided in the form of any pre-determined geometrical configuration. Moreover, a greater or lesser number than sixty-four (64) of such positions could be provided.

As clearly shown in FIG. 1, each square 12 has an Arabic numeral imposed thereupon. The specific pattern of numerals shown in FIG. 1, again, could be varied in view of this disclosure. However, it is highly preferable to provide the board game in the form shown, because the pattern of the numerals thereon corresponds to the pattern of numerals appearing in the Table of Numbers from the Book of Change. Accordingly, from a metaphysical standpoint, the specific pattern of numerals shown is important. Nevertheless, it must be stressed that in view of such metaphysical significance, a different arrangement of numbers could be employed, in such differing arrangement which would have a different metaphyscial or non-metaphyscial meaning. Thus, the scope of this invention, as defined in the claims appended hereto, is not restricted to the precise embodiment shown in FIG. 1.

In the novel game, regardless of the number of players, the game always commences with twenty-four (24) playing pieces on the playing board. When two players are opposing one another, their respective pieces are positioned as shown in FIG. 2, and as noted in the Brief Description of the Drawing portion hereof, FIGS. 3 and 4 show the starting positions of such pieces when 3 and 4 players are playing the game.

Accordingly, as this description proceeds it may be assumed that 2, 3, or 4 players are playing the game to be described, the only difference between such games being simply the arrangement of pieces at the commencement of each game.

Once the order of play has been determined by any suitable means, the players alternate their moves as in conventional games. However, the novel game sharply differs from conventional games in that two moves are allotted to each player per turn, which two (2) moves may be divided between two (2) pieces if desired. Moreover, when a move is accomplished by jumping an opponent's piece, such move does not count toward the total of two moves. Thus, in theory, a player could jump all of his opponent's pieces without using any of the two moves allotted to him. However, when a player jumps one of his own pieces, such a jump does count as one move, and no other jumps may be performed as a part of a second move. In a first embodiment of the invention, a move consists of moving a playing piece one square in any direction other than diagonal. For example, a playing piece on square 52 as shown in FIG. 1, can move to squares 4, 15, 23, or 39 in one move, assuming that such squares ae unoccupied. Thus, a player could move from square 52 to 23 on his first move, and to square 2, 18 or 8 on his second move, since returning to square 52 would be forbidden. Alternatively, a player could move from square 52 to square 39, and then move a second piece from another square to complete his move. If a square orthogonally contiguous to an occupied square is occupied, the playing piece may jump such contiguous occupied square if the next linearly adjacent square is unoccupied. Hence, a piece on square 52 could jump over square 4 if square 4 is occupied and if square 27 is unoccupied.

Importantly, a player may jump his own playing piece only one time for each move. However, one may jump an opponent's piece without being debited a move, as aforesaid. A very important feature of the invention is that when a playing piece jumps an opponent's piece for the first time, the opponent's playing piece is inverted. If the same piece is jumped a second time by an opposing piece, such piece is removed from the game. In this manner, every playing piece must be jumped twice before it is removed from the game. After the first jump, the piece is inverted, and for this reaason a suitable code is employed in each piece to identify both the upstanding and the inverted position of each playing piece. A suitable code is a color code, similar to the type shown in FIG. 5, for example. Any number of codes may be used. For example, the upper half of the playing piece could be provided with the letter "u" and the bottom half could be provided with the letter "d", such letters standing for up and down. Of course, the letters "t" and "b" could be employed to indicate top and bottom. In fact, any suitable visually ascertainable indicia may be employed. Preferably, however, the upper half of each playing piece is provided with primary color, and the lower half of each playing piece is provided with a secondary color so that inverted pieces may readily be identified.

In a simpler version of the game, one may remove one's opponent's pieces by jumping such pieces a single time. This of cource eliminates the inversion rule.

In video games, a player may remove a piece from the monitor, in some games, by pressing a button that is typically labelled "hyperspace". In such video games, when a piece goes into "hyperspace", it is removed from the monitor, which represents the game board, and re-appears at another place on said monitor shortly thereafter. Also, in video games such as Pac Man (Trademark) a character may exit the screen moving from left to right, only to reappear on the opposite side of the screen, again traveling from left to right. In like manner, in the inventive game, a piece can move from square 17 to square 25 in one move. As a further example, a piece can move from square 9 to square 61 in a single move. Thus, the game board is understood to represent more that two dimensions, and the equality of leaving and arriving is better understood by the game player. On a more profound level, the sameness of opposites is thereby expressed.

The game can be won by capturing all of the opponent's pieces by jumping them once in the simple version of the game or by jumping them twice when the inversion rule is being employed by the consent of the players. However, the game can also be won by arranging three of one's pieces in succession on an opponent's back row. Thus, referring to FIG. 2, a player could win the game by arranging three of his pieces successively on squares 17, 47, and 31. Since square 17 may be reached from square 25 in a single move, square 47 can be reached in a single move from 36 and square 31 can be reached from a single move from 33, it is seen that both players must employ a high degree of skill to achieve a victory by this route. For example, a player beginning at square 51 and moving to square 17 via square 25 will of course be immediately jumped by the opponent's piece on square 21.

In another variation of the game, moves may be made in a diagonal direction, in addition to the orthoganal directions. When a player has but three pieces left on the board, that player may move three squares each turn instead of the usual two. When a player has but two pieces left on the board, that player may move four squares each turn. When a player has but one piece left on the board, that player moves five squares each turn. Another variation of the game, wherein the players agree before the commencement of the game to play "for keeps", the winner of each game selects one of the opponent's pieces captured during the game, and keeps it. An opponent's piece remaining on the board at the end of the game may not be selected, however, unless no pieces have been captured when a three-in-a-row back row win is achieved. In such a case, a winner may select any one of the opponent's pieces from the board.

A winner may also select from a loser a piece that has been lost to that opponent earlier, even if the previously lost piece did not participate in the game. (Note: because each player must use pieces different from all opponent's pieces on the board, previously captured pieces woule not normally be re-entered onto the board by the capturing player.)

The winner of the match can be determined by simply counting the number of games won. For example, players can agree to play until one of them has accumulated seven wins.

In an alternative scoring system, captured opponent's pieces are scored as one point, games one are scored as five points, and the players play until one of them achieves a total of sixty-four (64) points. The highest total would win if more than one player were to achieve 64 or more points in the same game.

Referring now to FIG. 3, the rotation of the players involved is described as follows:

| | Player | | |
|---|---|---|---|
| Game | #1 | #2 | #3 |
| 1 | a | b | c |
| 2 | b | c | a |
| 3 | c | a | b |
| 4 | a | c | b |
| 5 | b | a | c |
| 6 | c | b | a |

Referring now to FIG. 4, the player rotation for a four-player game is identified as follows:

| | Player | | | |
|---|---|---|---|---|
| Game | #1 | #2 | #3 | #4 |
| 1 | a | b | c | d |
| 2 | a | d | c | b |
| 3 | a | c | d | b |
| 4 | a | b | d | c |
| 5 | a | d | c | b |
| 6 | a | c | b | d |

After such a set has been played, player number 2 is shifted to the number 1 slot, player number 3 is shifted to the number 2 slot, player number 4 is shifted to the number 3 slot, and number 1 is shifted to the number 4 slot. The shift is repeated every six games.

The player winning the last game of the set should read seriously the hexagram interpretation (in the Book of Changes) indicated by the number of the square on which the winning move is made. In this manner, the players will become acquainted with the hexagrams contained in the Book of Change, thereby enhancing their divination skills.

It is clear that the board game that has been shown and described is unlike any board game of the prior art.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limited sense.

It is also to be understood that the following claims are intended to cover all of the generic and specific features of the invention herein described, and all statements of the scope of the invention which, as a matter of language, might be said to fall therebetween.

Now that the invention has been described, that which is claimed is:

1. A method of playing a board game, comprising the steps of, providing a flat, two dimensional game surface means having peripheral boundaries defined in the marginal edges thereof, subdividing said game surface means into a plurality of two dimensional position defining regions, providing a plurality of game piece means divided into at least two different groups and provided with coding means so that the separate groups of game piece means are readily distinguishable by sensory inspection thereof, initially deploying said groups of game piece means upon said game surface means so that each game piece means is deployed upon a different one of said position defining regions, moving a preselected one of said game piece means from an occupied position defining region to any contiguous unoccupied region to complete a move, the players of said game alternating with one another in the making of said moves, allotting to each player a total of two moves per player turn, which two moves are taken as two consecutive moves of a single game piece means or as a single move of two game piece means belonging to said player, jumping an opponent's game piece means when said opponent's game piece means occupies a position defining region contiguous to that of one's game piece means and when said opponent's game piece means is intermediate an unoccupied position defining region and the region occupied by one's piece, jumping one's own game piece menas when one's game piece means to be jumped is intermediate an unoccupied position defining region and one's game piece means to be moved, deducting one move from one's total of two moves for each jumping of one's own game piece means, not deducting a move from one's total of two moves for each jumping of an opponent's game piece means, inverting said opponent's game piece means attendant jumping thereof to indicate a first jump of such opponent's game piece means, whereby said opponent's inverted game piece means remains in the possession of said opponent and remains on said game surface, and playing said game at least in part by moving said game piece means beyond the peripheral boundaries of said game surface means and returning said game piece means to said game surface means by crossing a peripheral boundary thereof that is oppositely disposed to the boundary across which a game piece means exited said game surface means.

2. The method of claim 1, further comprising the steps of, providing a reference source containing a body of categorized information, numerically encoding said position defining regions such that the code associated with each region identifies an associated category of information in said reference source, and consulting the category of information identified by the arrival of a game piece means upon the position-defining region associated with such category if such arrival constitutes a game winning move.

3. The method of claim 1, further comprising the steps of, removing an inverted and not re-inverted game piece means from the game surface means attendant a second jumping thereof by an opponent's game piece means and winning said game by removing all of an opponent's game piece means from said game surface means.

4. The method of claim 3, further comprising the steps of, moving one's inverted game piece means in the same manner as an uninverted game piece means, re-inverting an inverted game piece means to its initial, uninverted position when said inverted game piece means jumps an opponent's game piece means, whereby said re-inverted game piece means must be again be jumped twice prior to its removal from the game surface means.

5. The method of claim 3, further comprising the steps of, removing an inverted and not re-inverted game piece means from the game surface means attendant a second jumping thereof by an opponent's game piece means and winning said game by successfully deploying a pre-determined plurality of one's game piece means in contiguous relation to one another upon a pre-defined contiguous plurality of regions defended by one's opponent against such occupation.

6. The method of claim 5, further comprising the steps of, increasing the difficulty of winning said game as it progresses by providing additional moves to a losing player as the number of game piece means of such losing player remaining on the game surface decreases to a pre-determined threshold, and providing still further additional moves as still further game piece means of such losing player are removed from the game surface means.

7. The method of claim 6, further comprising the steps of, providing as many different groups of game piece means as there are numbers of players of said game, and deploying said game piece means in separate groupings upon said game surface means in preparation of playing said game.

* * * * *